United States Patent [19]

Morikawa et al.

[11] Patent Number: 4,700,604

[45] Date of Patent: Oct. 20, 1987

[54] MUSIC PLAYING SYSTEM

[75] Inventors: Shigenori Morikawa; Hiroyuki Sasaki, both of Tokyo, Japan

[73] Assignee: Casio Computer Co., Ltd., Tokyo, Japan

[21] Appl. No.: 6,314

[22] Filed: Jan. 14, 1987

Related U.S. Application Data

[63] Continuation of Ser. No. 657,575, Oct. 3, 1984, abandoned.

[30] Foreign Application Priority Data

Oct. 6, 1983 [JP] Japan ..... 58-187546
Jul. 25, 1984 [JP] Japan ..... 59-155030

[51] Int. Cl.[4] ..... G10H 1/36; G10H 7/00

[52] U.S. Cl. ..... 84/1.03; 84/DIG. 12; 84/425

[58] Field of Search ..... 84/115, 1.03, 1.01, 84/DIG. 6, DIG. 12, 425, 478; 340/365 VL

[56] References Cited

U.S. PATENT DOCUMENTS 4,226,154 10/1980 Easler ..... 84/1.03
4,345,501 8/1982 Nakada et al. ..... 84/1.03
4,380,947 4/1983 Nishimoto ..... 84/DIG. 3
4,653,375 3/1987 Handa et al. ..... 84/1.01

FOREIGN PATENT DOCUMENTS 1031702 5/1978 Canada ..... 340/365 VL

*Primary Examiner*—Arthur T. Grimley
*Assistant Examiner*—David Warren
*Attorney, Agent, or Firm*—Frishauf, Holtz, Goodman & Woodward

[57] ABSTRACT

A master electronic musical instrument and a slave electronic musical instrument are interconnected through a cable and music playing data is transferred from the master electronic musical instrument to the slave electronic musical instrument. The slave electronic musical instrument includes a tempo signal generator. The slave electronic musical instrument receives music playing data and generates tones according to the generated tempo signal.

6 Claims, 10 Drawing Figures

FIG. 3
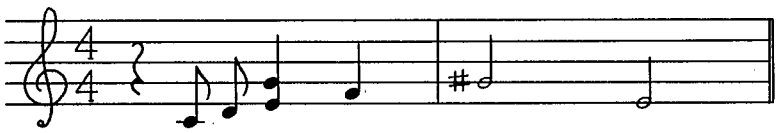
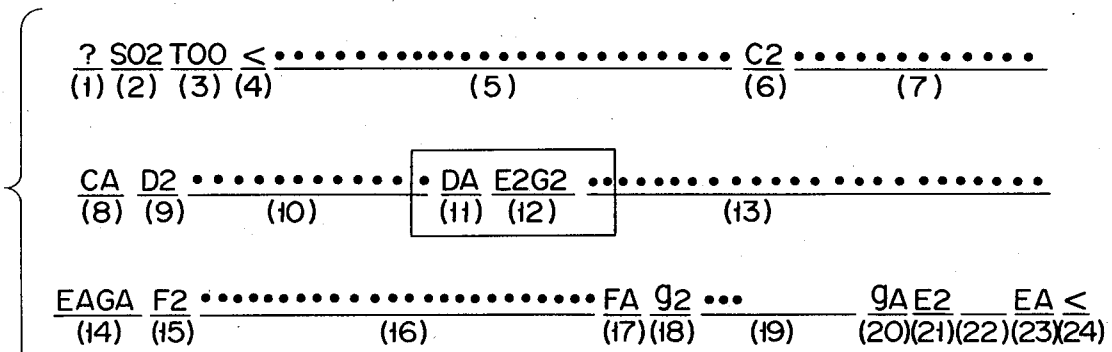
FIG. 4

MUSIC PLAYING SYSTEM

This application is a continuation of application Ser. No. 657,575, filed Oct. 3, 1984, and now abandoned.

BACKGROUND OF THE INVENTION

This invention relates to a music playing apparatus which has a combination of a master electronic apparatus and a slave playing apparatus such as an electronic musical instrument, which is connected to the master electronic apparatus.

Various music playing systems have been developed in which a personal computer, for instance, is used as a master electronic apparatus and a slave electronic musical instrument generates a sequence of tones according to programmed music playing data supplied from the personal computer.

There have also been developed various music playing systems, in which an electronic musical instrument is also employed as the master electronic apparatus and in which the master and slave electronic musical instruments both play music in synchronism to each other.

In such a case, the tempo of playing is usually set by transferring data which determines the tempo from the master side to the slave side. Therefore, it is impossible to vary the tempo while it is being played from the slave side. Particularly, when music is automatically played on the master side and manually played on the slave side, it is very inconvenient that the tempo cannot be varied by an instruction from the slave side. Further, where a personal computer is employed as a master side apparatus, it is necessary when changing the tempo to interrupt the program routine being executed, and then to correct the tempo-determining data and resume the routine. Doing so, however, is practically impossible while music is being played.

SUMMARY OF THE INVENTION

An object of the invention is to provide a music playing system in which the tempo can be readily changed during playing according to an instruction from the slave side.

According to the invention, there is provided a music playing system which comprises a master electronic apparatus for generating music playing data, a slave music playing apparatus including tempo setting means, a means for receiving music playing data transferred from the master electronic apparatus at a timing of transfer corresponding to a tempo set by the tempo setting means, and a means for generating tones according to the received music playing data.

BRIEF DESCRIPTION OF THE DRAWINGS

FIG. 3 is a view showing part of the music played by the embodiment;

FIG. 4 is a view showing commands corresponding to the music shown in FIG. 3;

DETAILED DESCRIPTION OF THE PREFERRED EMBODIMENTS

Preferred embodiments of the invention will now be described in detail with reference to the accompanying drawings.

Figure 1:
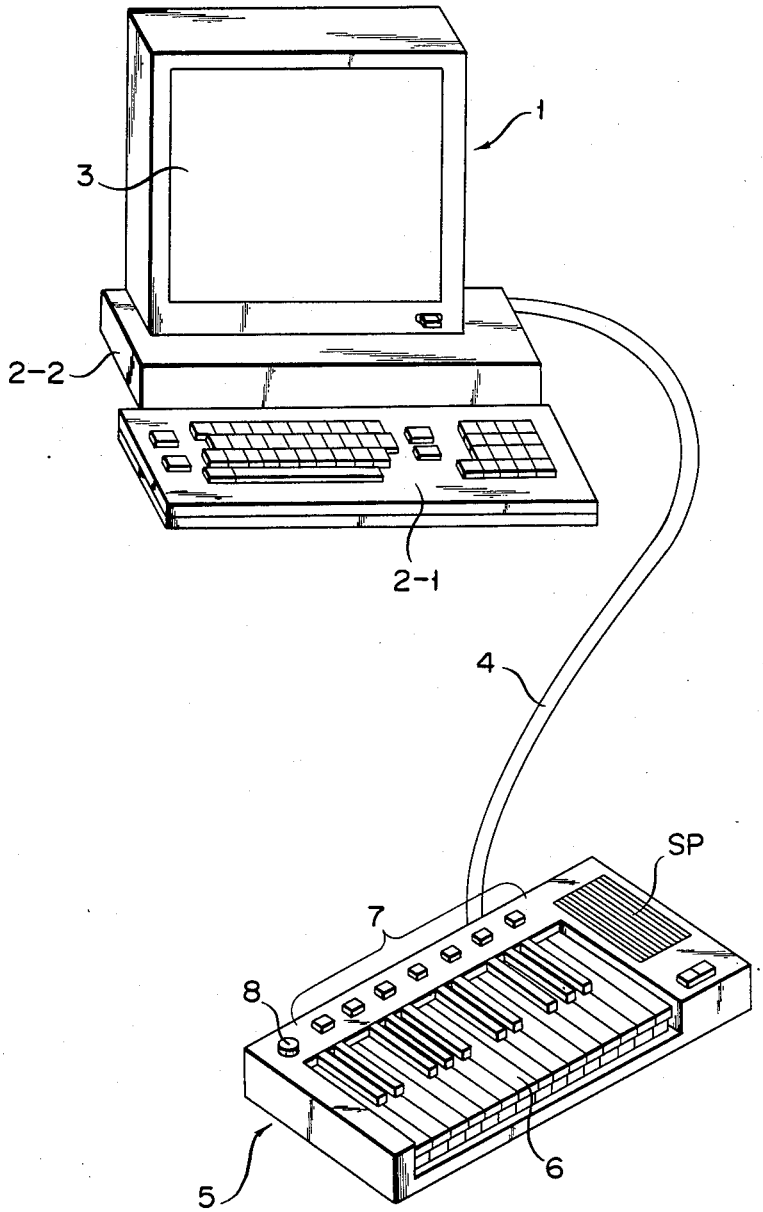
FIG. 1 is a perspective view showing an embodiment of the system according to the invention.

FIG. 1 shows an embodiment of the system according to the invention. There is shown a personal computer 1 which is used as a master electronic apparatus. The personal computer 1 includes a keyboard 2-1, a central processor 2-2 and a CRT display 3. The keyboard 2-1 has a plurality of keys for inputting various commands and data. The central processor 2-2 has an operational circuit, which performs operational processes according to data keyed from the keyboard 2-1 or data input from an external memory medium (not shown), e.g., a floppy disk, a magnetic recording cassette tape, and a ROM or RAM package. The CRT display 3 displays the input data or results of operational processes.

The personal computer 1 further has a printer port provided on the back of its casing. During the autoplay function, the printer port is also used as a data transfer port. It is connected to an electronic musical instrument 5 which is used as a slave play unit via a cable 4. The electronic musical instrument 5 includes an interface circuit for controlling the transfer of data to and from the personal computer 1 as well as for controlling a tone-generating circuit in the unit 5. The interface circuit may be a so-called MIDI (musical instrument digital interface) system or Centronics Standard interface circuit as will be described later. The interface circuit may be in the form of a package. A plurality of interchangeable interface circuit packages is prepared so that it can be selectively used in conformity with the language, software, etc., thus providing for increased versatility or universality.

The electronic musical instrument 5 includes a keyboard 6, which can be used when the instrument 5 is set to be used separately from the personal computer 1 or can be used to perform an accompaniment designated by the personal computer 1. The electronic musical instrument 5 also includes a switch group 7 for designating timbres and rhythms and also a tempo control knob 8 for controlling the tempo of the music played. It further includes a loudspeaker SP provided in its casing.

Figure 2:
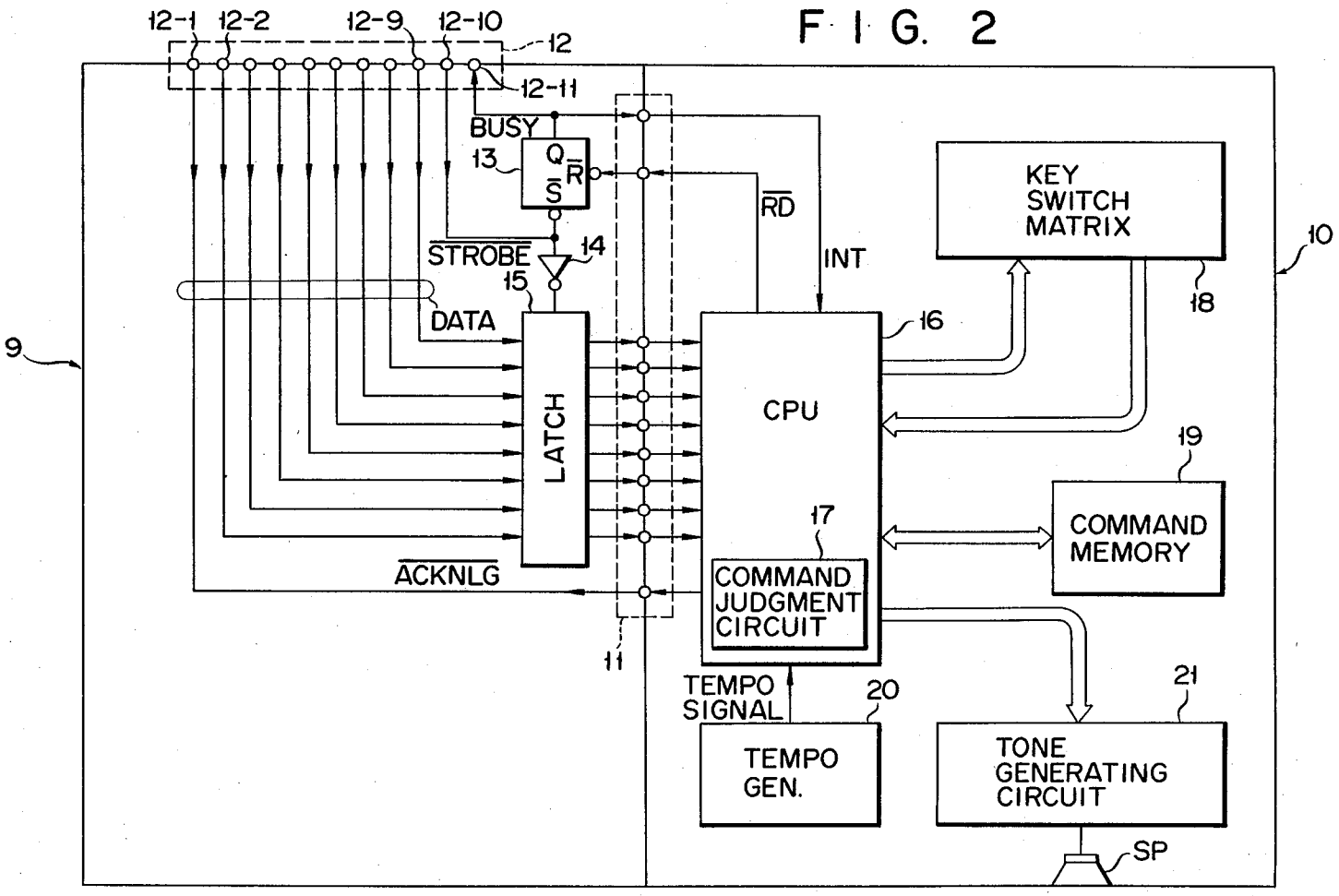
FIG. 2 is a block diagram showing the electric circuit construction of an electronic musical instrument shown in FIG. 1.

The electronic circuit construction of the electronic musical instrument 5 which is used as slave play unit will now be described with reference to FIG. 2. Referring to the figure, a Centronics Standard interface circuit section 9 and a tone-generating section 10 are shown interconnected. The two sections 9 and 10 can be interconnected through a connector terminal group 11.

The interface circuit section 9 has an input/output terminal group 12, which is connected to the personal computer 1. An 8-bit parallel data bus DATA leads data from the terminal group 12.

In this embodiment, the data bus DATA is uni-directional, but it may also be bilateral so that data can be transferred from the electronic musical instrument 5 to the personal computer 1 as well.

The input/output terminal group 12 includes a terminal 12-1 to which an acknowledge pulse $\overline{\text{ACKNLG}}$ is applied, and a terminal 12-11 to which a busy signal BUSY is applied. Signals are transferred through these terminals 12-2 to 12-9 from the electronic musical instrument 5 to the personal computer 1. The input/output terminal group 12 further includes a terminal 12-10 to which a strobe pulse $\overline{\text{STROBE}}$ is applied. Through these terminals 12-2 to 12-9, signal is transferred from the side of the personal computer 1 to the side of the electronic musical instrument 5.

The master side (i.e., the side of the personal computer 1 first determines 8-bit parallel data after confirming a non-busy state from the busy signal BUSY on the slave side (i.e., on the side of the electronic musical instrument 5). Then the master unit 1 sends out the data by transmitting a strobe pulse $\overline{\text{STROBE}}$, and waits for an acknowledge pulse $\overline{\text{ACKNLG}}$ as a reply from the slave unit 5. On the slave side, an SR flip-flop 13 is set by the strobe pulse $\overline{\text{STROBE}}$, whereupon the busy signal BUSY goes to a "H" level. Its output is held at a "H" level until there is established a state ready to receive the next data. The strobe pulse $\overline{\text{STROBE}}$ is inverted by an inverter 14 to obtain a read signal which is fed to a latch 15 which latches data on the data bus DATA. The output of the latch 15 is fed through the connector terminal group 11 to a CPU 16 and to the following circuits in the tone-generating section 10. When the CPU 16 completes given operations such as reading the data into the latch 15, it provides an acknowledge pulse $\overline{\text{ACKNLG}}$ which is fed through the terminal group 11 to the interface circuit section 9 and is thence transferred through the input/output terminal group 12 to the personal computer 1. The CPU 16 also provide a signal $\overline{\text{RD}}$ to the flip-flop 13 in the interminal face circuit section 9 to release the busy state. Thus, it is only after CPU 16 has completed a given processing on data supplied through the interface circuit section 9 that the reading of the next data transferred from the personal computer 1 into the CPU 16 is executed.

The output of the flip-flop 13 in the interface circuit section 9 is also fed as an interrupt signal INT to the CPU 16, whereby the CPU is informed of the fact that it is ready to read out data stored in the latch 15.

The CPU 16 consists of, for instance, a one-chip microprocessor and controls the operations in the electronic musical instrument 5. It includes a command judgement circuit 17 which judges commands transferred from the personal computer 1. The CPU 16 feeds a scanning signal to and receives a scanning result signal from a key switch matrix 18 which is provided in correspondence to the keyboard 6 or switch group 7.

A command memory 19 temporarily stores various commands (all of which are in the form of ASCII codes) transferred from the personal computer 1. A memory in the CPU 16 may of course be used for the memory 19.

The CPU 16 further receives a tempo signal generated from a tempo signal generator 20. The frequency of the tempo signal is determined by the tempo control knob 8.

The CPU 16 feeds data concerning tones for on or off to a tone-generating circuit 21 to control the sounding tones and also designates the timbres of tones. The tone-generating circuit 21 includes a rhythm generator for generating various rhythms. The CPU 16 further designates the kind of rhythm or rhythm pattern generated from the rhythm generator. The output signal from the tone-generating circuit 21 is fed to the loudspeaker SP to be sounded as a music sound.

Various commands used in this embodiment will now be described.

The commands that are transferred from the personal computer 1 as master unit to the electronic musical instrument 5 as slave unit include one-byte commands, 2-byte commands and 3-byte commands. The other block commands are read out up to an end "/" and are processed by non-operation (NOP) processing.

The one-byte commands include the following. "?" . . . This command is for initializing the tone-generating section 10 in the electronic musical instrument 5, i.e., for bringing about the same state to the section as when a power switch is turned on.

"<" . . . This command designates the start or stop of rhythm. It stops rhythm when the rhythm is in force, and starts rhythm when the rhythm is not in force.

"." . . . This command is for synchronizing the timing of data transfer between the tone-generating section 10 in the electronic musical instrument 5 and personal computer 1. The duration of a tone is set in correspondence to the number of these commands ".". For example, 24 commands "." are sent for a quarter note.

The 2-byte commands include the following.

"SO" . . . This command instructs note information and also instructs whether the corresponding tone is on or off. Note codes are as in Table 1 below.

TABLE 1

| do | do# | re | re# | mi | fa | fa# | sol | sol# | la | la# | si |
|---|---|---|---|---|---|---|---|---|---|---|---|
| C | c | D | d | E | F | f | G | g | A | a | B |

Octave codes also express the on or off of the tones and are as in Table 2 below.

TABLE 2

| | | | | | | | | |
|---|---|---|---|---|---|---|---|---|
| "On" octave | 0 | 1 | 2 | 3 | 4 | 5 | 6 | 7 |
| "Off" octave | 8 | 9 | A | B | C | D | E | F |

The 3-byte commands include the following. "S --" . . . These commands designate respective rhythms as in Table 3 below.

TABLE 3

| | |
|---|---|
| S00 | Lock |
| S01 | Disco |
| S02 | Swing |
| S03 | Waltz |
| S04 | Bosanova |
| S05 | Slow lock |

"T --" . . . These commands designate respective timbres of tone as in Table 4 below.

| | |
|---|---|
| T00 | Piano |
| T01 | Electric piano |
| T02 | Organ |
| T03 | Oboe |
| T04 | Clarinet |
| T05 | Vibraphone |
| T06 | Strings |
| T07 | Electric organ |

The operation that takes place when the personal computer 1 instructs the playing of the music shown in FIG. 3, will now be described.

The individual tones of the music shown in FIG. 3 are represented by the respective commands shown in FIG. 4. It is assumed that this piece of music is played in a swing rhythm with a piano timbre.

The commands shown in FIG. 4 are preliminarily set in a memory in the personal computer 1 from the keyboard 2-1. Their contents are displayed on the CRT display 3 and can be confirmed.

To explain the contents of the individual commands, numerals (1) to (24) are provided under the respective commands in FIG. 4 for the sake of convenience. Command (1) is an initialization command. Command (2) designates the kind of rhythm. Command (3) designates the piano timbre. The next command (4) represents the start of play. The next command (5) determines the timing. It consists of 24 successive commands "." and thus represents a quarter rest. Command (6) represents the start "on" of the first note do. The next command (7) represents an eighth note that is on for the duration of the note do and consists of 12 successive commands ".". The next command (8) represents the off state of the note do. Command (9) represents the start "on" of the note re subsequent to the off state of the note do. Command (10) represents an eighth note that is on for the note re and consists of 12 successive commands ".". The next command (11) represents the off state of the note re. The next command (12), which consists of two successive 2-byte commands, represents the start of the simultaneous on state of the notes mi and sol. The next command (13) shows a quarter note that is on for the notes mi and sol and consists of 24 successive commands ".". The next command (14), w consists of two successive 2-byte commands, represents the simultaneous off state of the notes mi and sol. The next command (15) represents the start "on" of note fa. The next command (16) designates a quarter note that is on for the note fa and consists of 24 successive commands "." The next command (17) r the off state of the note fa. The next command (18) represents that the note sol# is on. Command (19) represents that the note sol# is a half note and consists of 48 successive commands ".". The next command (20) represents the off state of the note sol#. Command (21) represents the start "on" of note mi. Command (22) consisting of 48 successive commands "." represents that the note mi is a half note. The next command (23) represents the off state of the note mi. The last command (24) represents that the playing should be stopped.

As has been shown, the piece of music shown in FIG. 3 is expressed as a series of commands as shown in FIG. 4. The operation when the electronic musical instrument 5 as the slave unit actually plays music in response to the transfer of the individual commands noted above from the personal computer 1 as the master unit, will now be described with reference to the flow chart of FIG. 5. The flow chart illustrates a program for processing the CPU 16.

First a desired tempo is preset by operating the tempo control knob 8 of the electronic musical instrument 5. The tempo signal generator 20 thus generates a tempo signal at the preset frequency.

The personal computer 1 transfers the first command (1) to the interface circuit section 9. The command (1) is latched in the latch 15. That is, the personal computer 1 presets the command (1) in the latch 15 by applying a strobe signal $\overline{\text{STROBE}}$ thereto. As a result, the flip-flop 13 is set. The busy signal BUSY is thus provided, and the interrupt signal INT is inverted to the "H" level.

Figure 5:
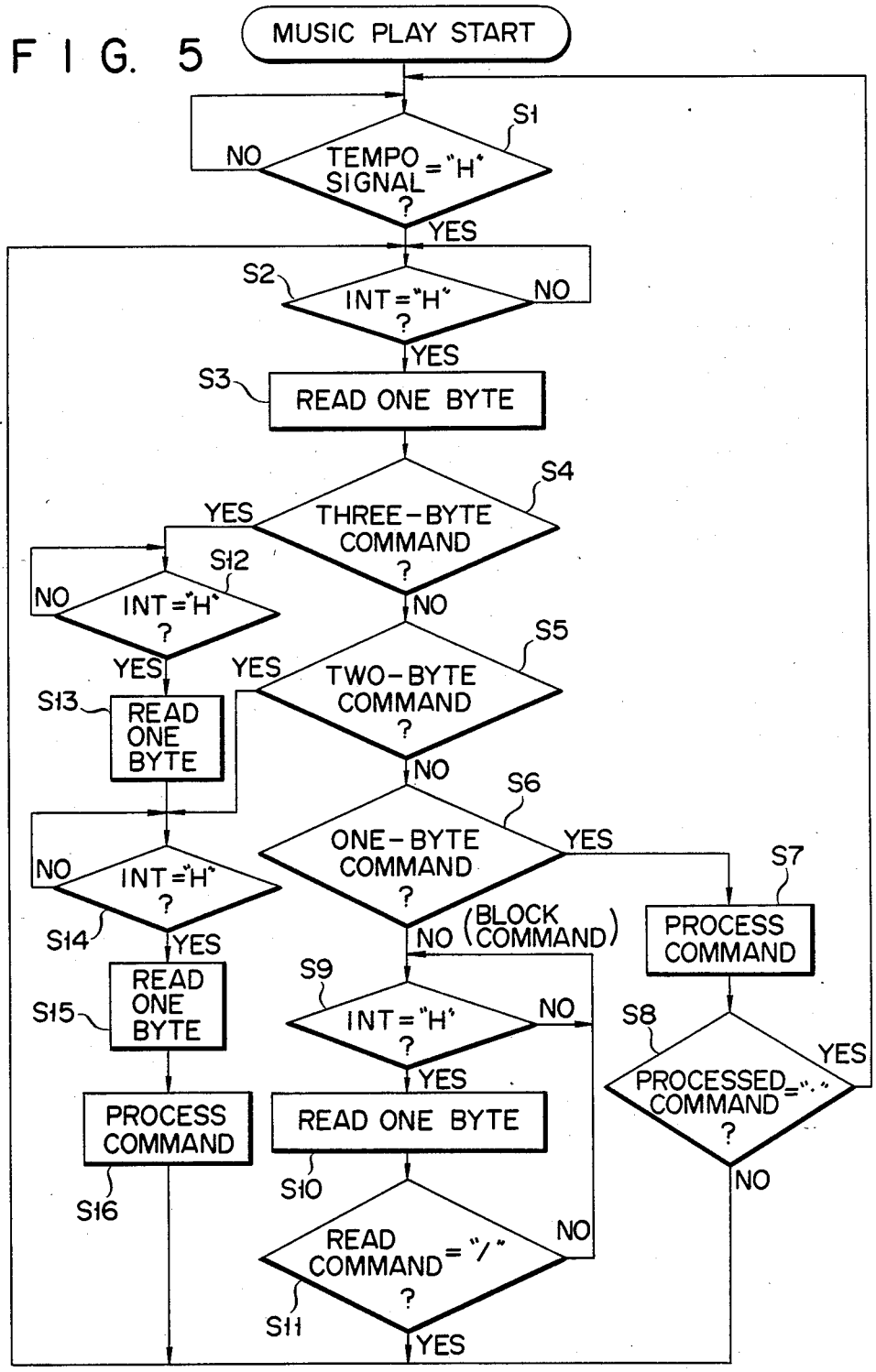
FIG. 5 is a flow chart explaining the operation of the CPU shown in FIG. 2.

In the CPU 16, step S1 shown in FIG. 5 is executed. With the inversion of the tempo signal to the "H" level, step S1 yields a decision "Yes" so that the program routine goes to a step S2, in which a check is done as to whether or not the output INT of the flip-flop 13 is at the "H" level. Since this step S2 yields a decision "Yes," the routine goes to step S3, in which the CPU 16 reads out data from the latch 15. The data read out at this time is the command (1) shown in FIG. 4. This command (1) is stored in the command memory 19.

Subsequently, in step S4, a check is done as to whether or not the command is 3-byte command. In the instant case, a decision "No" is yielded, so that the routine goes to step S5. In step S5, a check is done as to whether or not the command is a 2-byte command. A decision "No" is again yielded by so that the routine goes to step S6.

In step S6, a check is done as to whether or not the command is a one-byte command. In the instant case, a decision "Yes" is yielded, so that the subsequent steps S7 and S8 are executed.

In this embodiment all commands given are either one-byte, 2-byte or 3-byte commands. If any other block command than these commands is transferred from the personal computer 1, step S6 yields a decision "No", so that the routine goes on to step S9. In step S9, a check is done as to whether or not the interrupt signal INT which indicates that the next command has been set in the latch 15 is at the "H" level.

When the command read out from the latch 15 is transferred to the command memory 19, the CPU 16 provides a signal $\overline{\text{RD}}$ to the flip-flop 13 to release the busy state. Also, it provides an acknowledge pulse $\overline{\text{ACKNLG}}$ to the personal computer 1, informing the same of the fact that the reading of the previous command transferred to the latch 15 has been read into the CPU 16. The personal computer 1 thus transfers the next command, which is fed through the data bus DATA to the latch 15 to be set therein. In the case of a command longer than a 3-byte command, i.e., a block command, with the input of the next command step S9 yields a decision "Yes," so that the routine goes to step S10 in which data is read out from the latch 15. In the subsequent step Sll, a check is done as to whether or not the read-out command is an end command "/". If the decision is no, the routine goes back to step S9. If the decision is yes, the routine goes back to step S2. If steps S4 to S6 all yield a negative decision so that the routine goes to step S9, steps S9 through Sll are repeatedly executed, causing the commands to be read out from the personal computer 1 and processed by nonoperation processing (NOP) until the end command "/" is read out.

In the instant case, the transferred command is "?", and so the routine goes from step S6 to step S7. The CPU 16 thus initializes the individual circuits such as the tone generating circuit 21, and the routine then goes to the step S8.

In step S8, a check is done as to whether the pertinent command is a command ".". In the instant case a negative decision "No" is yielded, so that the routine goes back to the step S2.

With the positive decision "Yes" yielded by step S2, the routine goes to step S3. In the instant case, the first one byte of the 3-byte command "S02" shown in FIG.

4 is in the comman memory 19. Since a decision "Yes" is yielded by step S4, the routine goes to a step S12. If the next byte has been transferred from the personal computer 1, step S12 would yield a decision "Yes", making the routine go on to step S13, in which the second byte of the command, i.e., "0", is read into the command memory 19. Subsequently, at step S14, a check is done as to whether the next byte has been transferred from the personal computer 1. If a decision "Yes" is yielded, the routine goes to step S15 in which the last byte "2" is set in the command memory 19.

In step S16, the CPU 16, i.e., command judgement circuit 17, detects that the 3-byte command designates the rhythm for swing. Thus, the CPU 16 provides data designating the swing rhythm to the tone-generating circuit 21. The tone-generating circuit 21 thus starts to produce the swing rhythm from an instant to be described later.

Subsequent to step S16, step S2 is executed and if step S2 yields a decision "Yes", step S3 is executed. Since at this time again the first byte of a 3-byte command "TOO" has been transferred, the next yields a decision "Yes", so that the steps S12 through S16 are executed in the manner as described. In the instant moment, it is detected in the step S16 that the command designates the timbre of a piano. The CPU 16 thus provides data designating the timbre of a piano to the tone-generating circuit 21 to be ready to start sounding.

The routine then goes again to step S2. The next command is the command (4) shown in FIG. 4 representing the start of the playing, so that steps S3 through S7 are executed. In step S7, a command for starting the rhythm is given to the tone-generating circuit 21. The playing of a swing rhythm thus takes place.

In step S8, a decision "No" is yielded, so that step S2 is executed, and the next command is read into the CPU 16 in step S3. Since the command is ".", steps S4 through S8 are then executed. In step S8, a decision "Yes" is yielded, so that the routine goes back to step S1.

In step S1, a stand-by state is held until the tempo signal generator 20 generates the tempo signal. When the tempo signal is generated, step S1 yields a decision "Yes", causing the routine to go to step S2. Consequently, steps S2 through S8 are executed, and then the routine returns to step S1. In this way, steps S1 through S8 are repeatedly executed so long as the personal computer 1 provides the command ".". The tone is thus off, i.e., the rest is continued, for a period corresponding to the product of the period of the tempo signal and the number of the commands "." transferred. In the instant case, the period is a quarter rest.

Thus, the tempo of play executed according to the play data transferred from the personal computer 1 can be set by the tempo control knob 8 of the electronic musical instrument 5, corresponding to the stand-by period in step S1.

When 24 commands "." have been supplied, command (6) in FIG. 4 is then supplied from the personal computer 1. This time, step S5 yields a decision "Yes", so that steps S14 through S16 are executed. Thus, in step S16 it is detected that the 2-byte command represents the start "on" of the and CPU 16 informs the tone-generating circuit 21 that the tone is on. The tone-generating circuit 21 executes the "on" processing of the note, which is thus sounded through the loudspeaker SP.

The routine then returns to step S2 and then goes to step S3 to read the next command ".". As a result, steps S4 through S6 are executed. Step S8 yields a decision "Yes", so that the routine goes back to step S1. Thus, the stand-by state is similarly held in step S1 until the tempo signal is generated, and thereafter the routine goes to step S2. In this way, with command (7) in FIG. 4, the tone-generating circuit 21 can generate the note do for a period corresponding to the number of transferred commands ".", i.e., for the duration of an eighth note. During this period, steps S1 through S8 are repeatedly executed.

When command (8) in FIG. 4 is read out, the CPU 16 executes steps S1 through S5, and S14 through S16. In the instant case, in step S16 CPU 16 gives the tone-generating circuit 21 a control signal commanding the note do be switched from on to off.

Subsequently, steps S2 and S3 are executed, and when CPU 16 reads out the first byte of the next command (9) from the latch 15, step S5 yields a decision "Yes", so that steps S14 through S16 are executed. Thus, the generation of the next tone re is instructed to the tone-generating circuit 21. The next command (10) is similarly processed, so that the note re is held on for a period corresponding to the duration of the eighth note.

Figure 6:
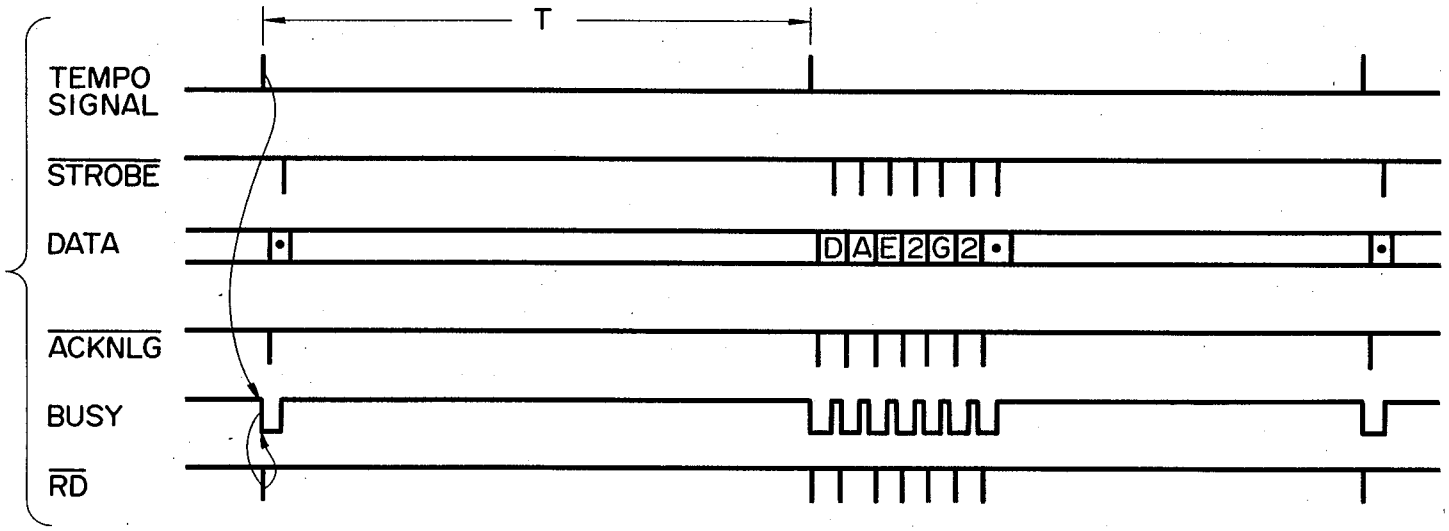
FIG. 6 is a timing chart showing signals related to various parts shown in FIG. 2.

In the above way, music is played according to the music playing data transferred from the personal computer 1. FIG. 6 shows a timing chart of signals in the case when the portion shown enclosed in a rectangle in FIG. 4, i.e., the last part of the command (10), commands (11) and (12) and begining part of the command (13), is transferred from the personal computer 1 through the interface circuit section 9. First, steps S1 through S3 are executed according to the tempo signal provided from the tempo signal generator 20. As a result, the CPU 16 reads out the command "." which has already been set in the latch 15. Then it provides the acknowledge pulse $\overline{\text{ACKNLG}}$ to the personal computer 1 and also provides the signal $\overline{\text{RD}}$ to the flip-flop 13 to reset the busy signal BUSY. In the CPU 16, steps S4 to S8 are similarly executed, and the stand-by state is set in the step S1.

In the personal computer 1, it is confirmed from the acknowledge pulse $\overline{\text{ACKNLG}}$ that the previously transferred command "." has been read into the CPU 16. When the busy signal BUSY is inverted to the "L" level, the next command, i.e., the first byte "D" in the instant case, is provided to the data bus DATA, and a strobe pulse $\overline{\text{STROBE}}$ is applied to the latch 15. As a result, the data "D" is latched in the latch 15. Also, the flip-flop 13 is set by the strobe pulse $\overline{\text{STROBE}}$, so that the subsequent transfer of data from the personal computer 1 is inhibited until the busy state is released.

After the lapse of time T shown in FIG. 6, the tempo signal generator 20 generates a tempo signal so that a similar processing to that described above is executed. More specifically, the CPU 16 executes steps S2 through S5, and S14 through S16 to send the command "DA" to turn off the note re in the tone-generating circuit 21, then repeatedly executes a similar step processing twice to read command (12) shown in FIG. 4 and to instruct the simultaneous start "on" of the notes of mi and sol to the polyphonic tone-generating circuit 21, which operates on a time division basis.

The processing of this time is executed continuously as shown in FIG. 6. This is done because step S1 is not looped.

When the command "." is read out by the CPU 16, stand-by is maintained until the input of the next tempo signal. In this way, the piece of music is progressively played, and when the last command (24) is read out, the CPU 16 gives a control signal to the tone-generating circuit 21 to entirely stop the playing.

As has been shown in the above embodiment, the tempo signal generator 20 generates a tempo signal for a period which is set by the tempo control knob 8 of the electronic musical instrument 5 as the slave unit, and the commands "." are processed in synchronism to play the input of the tempo signal. Thus, it is possible to select tones or rests for durations corresponding to the number of commands "." transferred from the personal computer 1. Besides, the period of the tempo signal is variable even during playing by manipulating the tempo control knob 8, permitting ready changes of the tempo.

In the above embodiment, music has been played as the personal computer 1 as master unit provides various control commands to the electronic musical instrument 5, but the role of the personal computer may be realized by various other electronic calculators such as a programmable calculator, a minicomputer, etc. as well. Further, a play apparatus such as an electronic musical instrument may be used as a master unit. Further, the play apparatus is not limited to electronic keyboard musical instruments but may be of any form so long as a tone-generating function is provided.

Moreover, the tempo control command is not limited to that in the above embodiment but can be variously modified.

Now, a different embodiment of the system according to the invention will be described, in which both the master and slave units employ electronic musical instruments, with reference to FIGS. 7 through 10.

Figure 7:
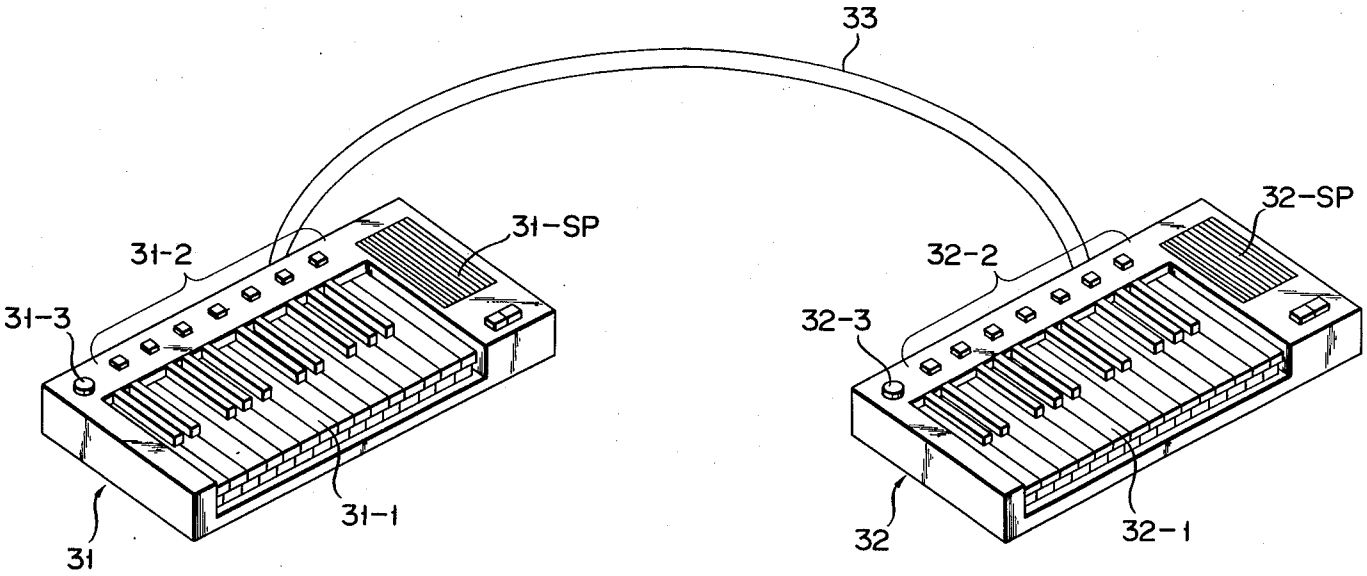
FIG. 7 is a perspective view showing a different embodiment of the system according to the invention.

FIG. 7 shows the embodiment. Referring to FIG. 7, there are shown a master electronic musical instrument 31 and a slave electronic musical instrument 32, these two electronic musical instruments being interconnected by a cable 33. The slave electronic musical instrument 32 includes an interface circuit for controlling the transfer of data to and from the master electronic musical instrument 31 in addition to a tone-generating circuit as in the preceding embodiment of FIG. 1.

The electronic musical instruments 31 and 32 include, respectively, keyboards 31-1 and 32-1 switch groups 31-2 and 32-2 for designating timbres and rhythms, and a tempo control means, e.g., tempo control knobs 31-3 and 32-3, for controlling the playing tempo. They further include respective loudspeakers 31-SP and 32-SP provided in their casings.

Figure 8:
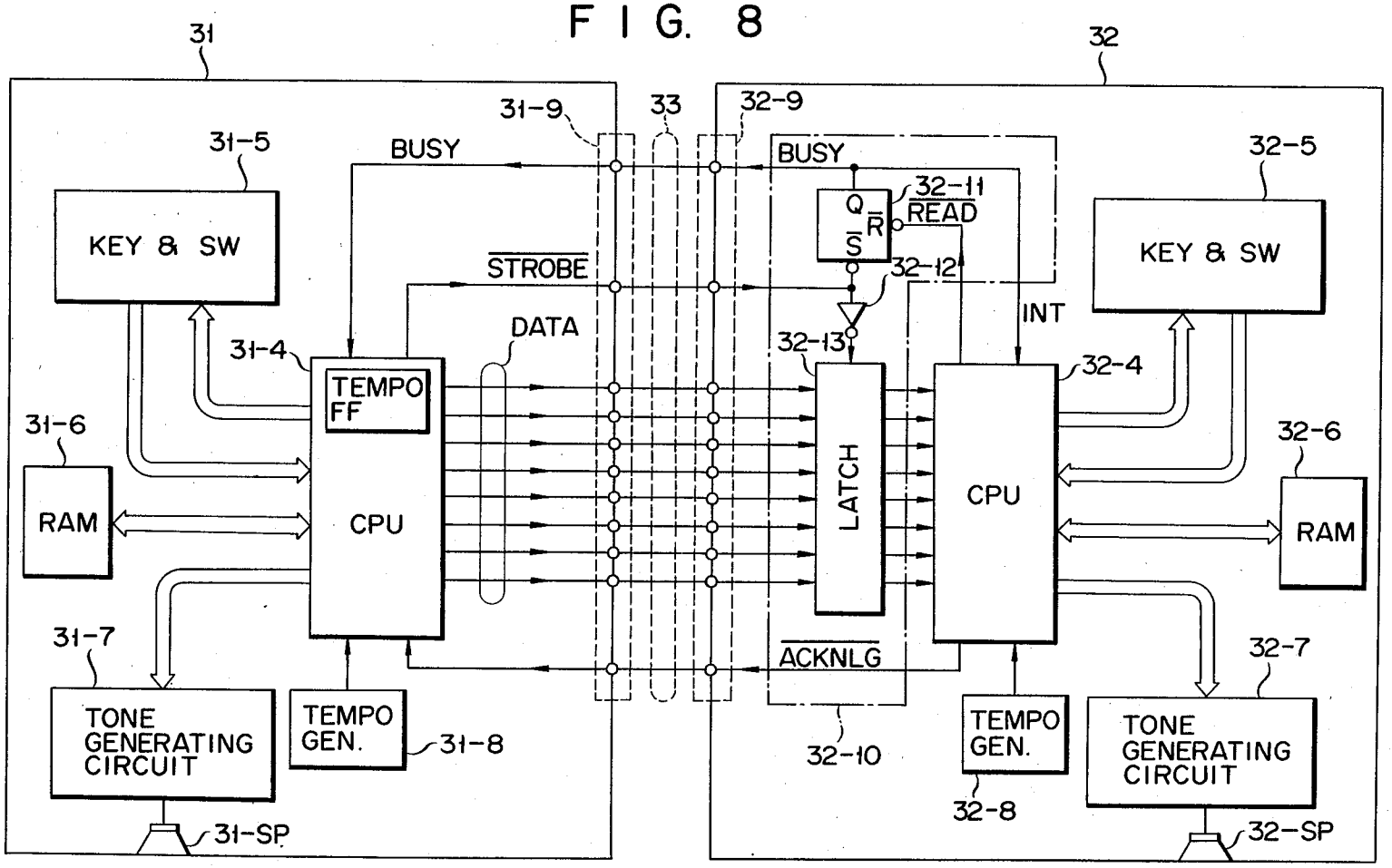
FIG. 8 is a block diagram showing the electric circuit construction of the system shown in FIG. 7.

The internal circuit construction of the electronic musical instruments 31 and 32 will now be described with reference to FIG. 8. The master side electronic musical instrument 31 includes a CPU 31-4. The CPU 31-4 consists of, for instance, a one-chip microprocessor and controls the operation of the electronic musical instrument 31. It has a tempo flip-flop FF. A keyswitch matrix 31-5, a RAM 31-6 in which play data is stored, a tone-generating circuit 31-7 and a tempo generator 31-8 are connected to the CPU 31-4. The keyswitch matrix 31-5 is provided in correspondence to the keyboard 31-1 and switch group 31-2. It is scanned by the CPU 31-4. In the RAM 31-6 is stored various play data, which is read into the CPU 31-4 for the autoplay function. The tempo generator 31-8 supplies a tempo signal to the CPU 31-4. The frequency of the tempo signal is determined by the tempo control knob 31-3. The CPU 31-4 receives the tempo signal from the tempo generator 31-8 only when the master electronic musical instrument 31 is used as an ordinary play unit. When autoplay is performed with the slave electronic musical instrument 32, the tempo is set according to a signal from the slave electronic musical instrument 32. The CPU 31-4 feeds on or off tone data to the tone-generating circuit 31-7 to control the sound, and also designates the timbre of the tones. The tone-generating circuit 31-7 has a rhythm generator for generating various rhythms. The CPU 31-4 designates the kind of rhythm or a rhythm pattern generated by the rhythm generator. The output signal of the tone-generating circuit 31-7 is fed to the loudspeaker 31-SP to be converted into a sound signal and sounded.

The master electronic musical instrument 31 is connected through an input/output terminal group 31-9, the cable 33 and an input/output terminal group 32-9 to the slave electronic musical instrument 32. The CPU 31-4 in the master electronic musical instrument 31 provides 8-bit play data, which is transferred through data bus DATA and input/output terminal groups 31-9 and 32-9 to the slave electronic musical instrument 32. The input/output terminal groups 31-9 and 32-9 include terminals, to which a strobe pulse $\overline{\text{STROBE}}$ is applied. Signals are transferred from the master electronic musical instrument 31 to the slave electronic musical instrument 32 through these terminals. The input/output terminal groups 31-9 and 32-9 also include terminals, to which an acknowledge pulse $\overline{\text{ACKNLG}}$ is applied, and also terminals, to which a busy signal BUSY is applied. Through these terminals, signals are transferred from the slave electronic musical instrument 32 to the master electronic musical instrument 31.

The slave electronic musical instrument 32, like the master electronic musical instrument 31, includes a CPU 32-4 for controlling the operation of the instrument 32, a keyswitch matrix 32-5, a RAM 32-6 in which play data is stored, a tone-generating circuit 32-7, a tempo generator 32-8 and a loudspeaker 32-SP. The CPU 32-4 is connected to the master electronic musical instrument 31 via an interface circuit 32-10.

In the Centronics Standard interface circuit 32-10, the transmitting side (i.e., the master electronic musical instrument 31) determines 8-bit parallel data after confirming from the busy signal BUSY from the receiving side (i.e., the slave electronic musical instrument 32) that there is no busy state. The master instrument 31 causes data to be input by sending a strobe pulse $\overline{\text{STROBE}}$, and waits for an acknowledge pulse $\overline{\text{ACKNLG}}$. On the slave side the strobe pulse $\overline{\text{STROBE}}$ is set by the SR flip-flop 32-11, and the busy signal BUSY is inverted to the "H" level. The output is thus held at the "H" level until it is ready to receive the next data. The strobe pulse $\overline{\text{STROBE}}$ is inverted by an inverter 32-12 to be fed as a read signal to a latch 32-13. The latch 32-13 latches data on the data bus DATA according to the read signal, and feeds the latched data to the CPU 32-4. The CPU 32-4 reads out data held in the latch 32-13. When it completes the reading, it provides an acknowledge pulse $\overline{\text{ACKNLG}}$. The acknowledge pulse $\overline{\text{ACKNLG}}$ is transferred through the interface circuit 32-10 and input/output terminal groups 32-9 and 31-9 to the master electronic musical instrument 31. The CPU 32-4 further feeds a signal $\overline{\text{READ}}$ to the flip-flop 32-11 in the interface circuit 32-10 to release the busy state. It is only after the CPU 32-4 has processed data supplied through the interface circuit 32-10 that the next data fed from the master electronic musical instrument 31 can be read into the CPU 32-4.

The output of the flip-flop 32-11 in the interface circuit 32-10 is fed as an interrupt signal to the CPU 32-4, whereby the CPU 32-4 is informed of the fact that it is ready to read out data stored in the latch 32-13.

The operation of the second embodiment will now be described in connection with the music shown in FIG. 3 as played by the electronic musical instruments 31 and 32. As mentioned before, the individual data of the music of FIG. 3 is represented by the respective commands shown in FIG. 4. The commands shown in FIG. 4 are preliminarily stored in the RAM 31-6 in the master electronic musical instrument 31. In this case, it is possible to write tone data into the RAM 31-6 from the keyboard 31-1.

Figure 9:
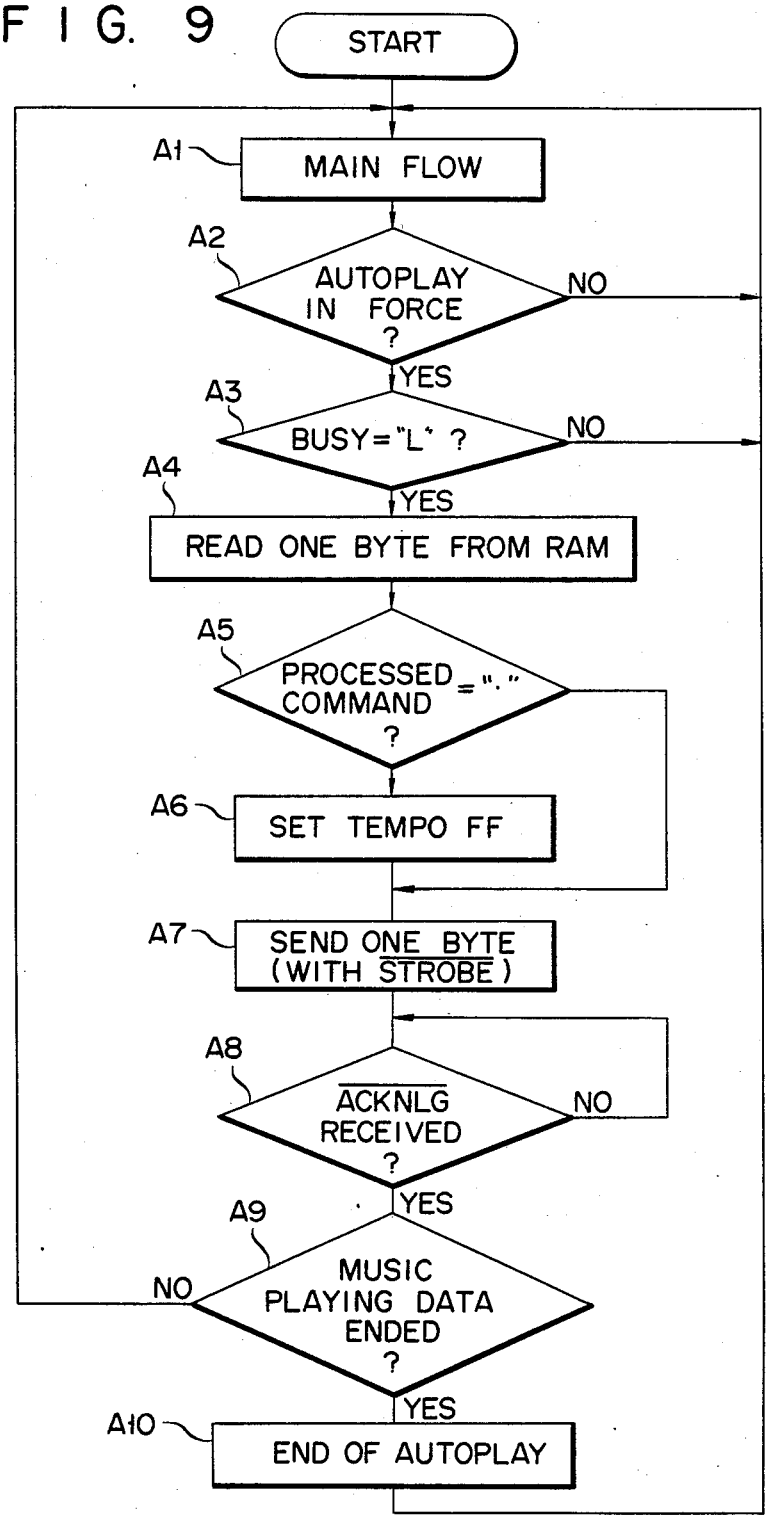
FIG. 9 is a flow chart explaining the operation of a CPU in the master electronic musical instrument shown in FIG. 8.
Figure 10:
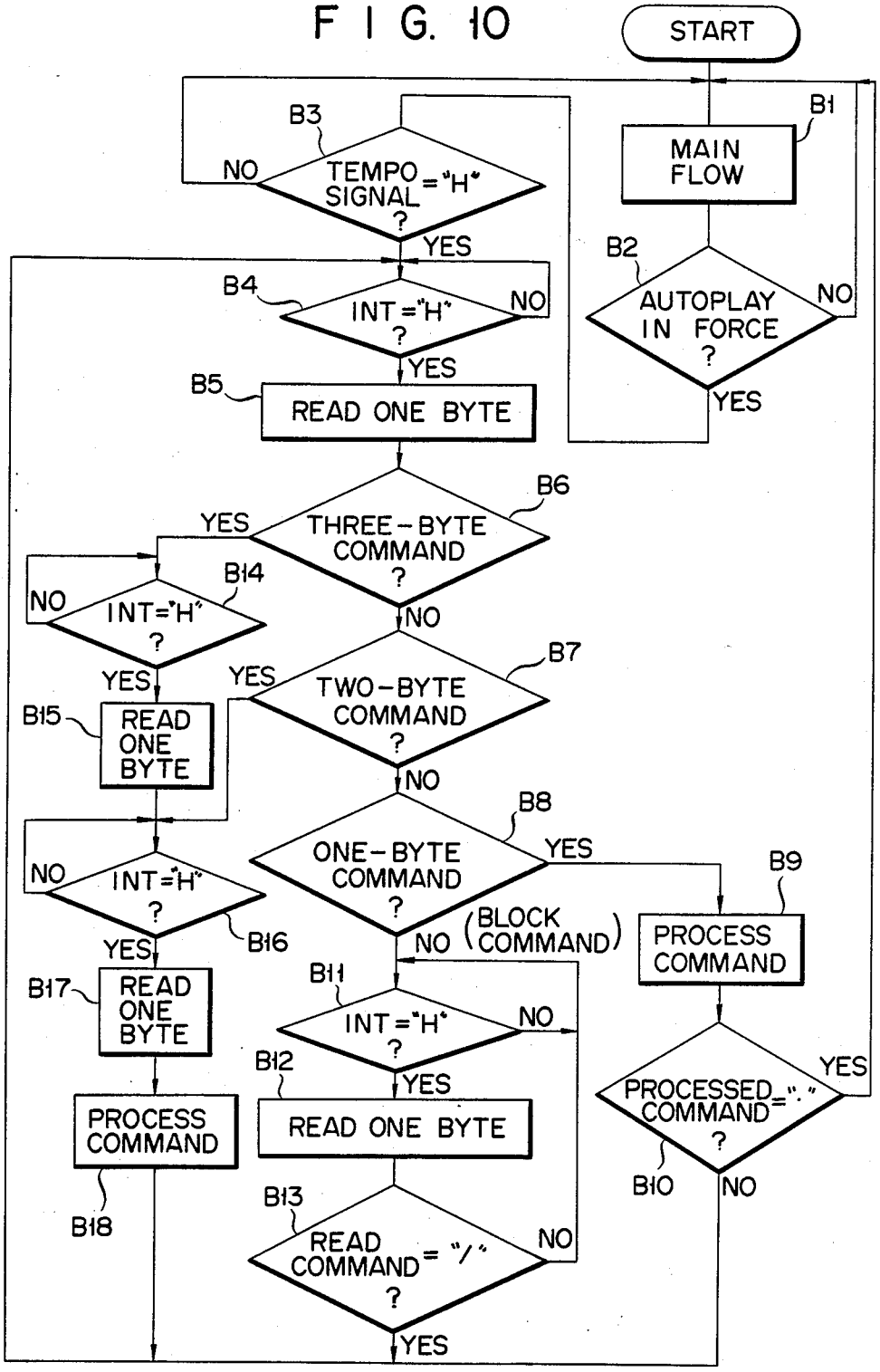
FIG. 10 is a flow chart explaining the operation of a CPU in the slave electronic musical instrument shown in FIG. 8.

As mentioned earlier, the piece of music shown in FIG. 3 is represented by a series of commands as shown in FIG. 4. Now, the operation when the music is played synchronously by the master electronic musical instrument 31 and slave electronic musical instrument 32, according to the individual commands, will now be described with reference to the flow charts of FIGS. 9 and 10. The flow chart of FIG. 9 illustrates the operation of the master electronic musical instrument 31, while the flow chart of FIG. 10 illustrates the operation of the slave electronic musical instrument 32. These figures explain the program routines of the CPUs 31-4 and 32-4.

First, a desired tempo is set by the tempo control knob 32-3 of the slave electronic musical instrument 32. The tempo generator 32-8 generates the tempo signal at a preset frequency. In the master electronic musical instrument 31, an autoplay mode is set, and the start of the operation is instructed. With the instruction of the start of operation, the program routines shown in FIGS. 9 and 10 are started.

In the master electronic musical instrument 31, a main flow processing step A1 in FIG. 9 is first executed, in which any operated key on the keyboard 31-1 and any operated switch of the switch group 31-2 are checked for, and corresponding data processing is executed. In subsequent step A2, whether or not autoplay is in force is checked. If autoplay is not in force, the routine goes back to step A1. In the instant case, autoplay is in force, and so step A3 is executed in which a check is done as to whether or not the busy signal BUSY from the slave electronic musical instrument 32 is at "L" level. If the busy signal BUSY is not at the "L" level, no command can be transferred to the slave electronic musical instrument 32, so that the routine goes back to step A1. If it is found in step A3 that the busy signal BUSY is at the "L" level, the routine goes to step A4, in which a one-byte command is read out from the RAM 31-6 into the CPU 31-4. In a subsequent step A5, a check is done as to whether or not the pertinent command is ".". If the command is ".", step A6 is executed, in which the tempo flip-flop FF is set. The flip-flop FF is set in order to let the tempo of playing in the master side electronic musical instrument 31 coincide with that at the instant when the command "." is read into the slave electronic musical instrument 32. After the flip-flop FF is set or if it is found in the step A5 that the command is not ".", step A7 is executed, in which the one-byte command having been read out from the RAM 31-6 into the CPU 31-4 is transferred together with a strobe pulse $\overline{\text{STROBE}}$ to the slave electronic musical instrument 32. In a subsequent step A8, this state is held until an acknowledge pulse $\overline{\text{ACKNLG}}$ is transferred from the slave electronic musical instrument 32. When the strobe pulse $\overline{\text{STROBE}}$ is transferred from the slave electronic musical instrument 32 to the master electronic musical instrument 31, a one-byte command from the CPU 31-4 is latched in the latch 32-13 in synchronism to this. Further, the strobe pulse sets the flip-flop 32-11 to invert the busy signal BUSY and interrupt signal INT to the "H" level. When the interrupt signal INT is inverted to the "H" level, the CPU 32-4 reads out the data from the latch 32-13 and then transfers an acknowledge pulse $\overline{\text{ACKNLG}}$ through the interface circuit 32-10 to the master electronic musical instrument 31. When the acknowledge pulse $\overline{\text{ACKNLG}}$ is transferred from the slave electronic musical instrument 32 to the master electronic musical instrument 31, step A9 is executed, in which a check is done as to whether the music playing data has ended. If it has ended, the routine goes to the step A1 to continue playing. In step A1, processing is executed according to the content of the operation of the keyboard 31-1 and switch group 31-2. Also, "on" or sounding processing, "off" processing, etc. are done according to commands read out from the RAM 31-6. Further, if it is found in step A6 that the tempo flip-flop FF has been set, it is reset after generation of a timing clock.

A similar operation is subsequently repeated, and if it is found in step A9 that music playing data has ended, step A10 is executed, in which an end-of-autoplay process is done. The routine then goes back to step A1.

In the slave electronic musical instrument 32, with the start of the routine, a main flow processing step B1 in FIG. 10 is executed in which any operated key on the keyboard 32-1 and any operated switch in the switch group 32-2 are checked and the corresponding data processing, and sounding "on" and "off" processing are executed. In a subsequent step B2, a check is done as to whether or not autoplay is in force. If autoplay is not in force, the routine goes back to the main flow process of step B1. In the instant case autoplay is in force, so the routine goes to step B3, in which a check is done as to whether or not the tempo signal form the tempo generator 32-8 is at "H" level. When the tempo signal is inverted to the "H" level, step B3 yields a decision "Yes", so that the routine goes to step B4. Since the output INT of the flip-flop 32-11 is at the "H" level, the routine goes to step B5, in which the CPU 32-4 reads out data from the latch 32-13. This data is the command (1) in FIG. 4. In a subsequent step B6, a check is done as to whether or not the command is a 3-byte command. In the instant case, a decision "No" is yielded, so the routine goes to step B7. In step B7, a check is done as to whether or not the command is a 2-byte command. In the instant case a decision "No" is yielded, so the routine goes to step B8.

In step B8, a check is done as to whether or not the command is a one-byte command. In the instant case, a decision "Yes" is yielded, so that the subsequent steps B9 and B10 are executed.

In this embodiment, all commands given are either one-byte, 2-byte or 3-byte commands. If any other block command than these commands is transferred from the master electronic musical instrument 31, step B8 will yield a decision "No" so that the routine goes to step B11. In step B11, a check is done as to whether or not the interrupt signal INT which indicates that the next command has been set in the latch 32-13 is at the "H" level.

When the CPU 32-4 reads out the command from the latch 32-13, it provides the signal $\overline{\text{READ}}$ to the flip-flop 32-11 to release the busy state. Also, it provides an acknowledge pulse $\overline{\text{ACKNLG}}$ to the master electronic musical instrument 31, informing the same of the fact that the reading of the previous command transferred to the latch 32-13 has been read into the CPU 32-4. The master electronic musical instrument 31 thus transfers the next command, which is fed through the data bus DATA to the latch 32-13 to be set therein. In the case of a command longer than a 3-byte command, i.e., a block command, with the input of the next command, step B11 yields a decision "Yes", so that the routine goes to step B12, in which data is read out from the latch 32-13. In a subsequent step B13, a check is done as to whether the read-out command is an end command "/". If a decision "No" is yielded, the routine goes back to step B11. If the decision is "Yes", the routine goes back to step B4.

If steps B6 to B8 all yield a decision "No" so that the routine goes to step B11, steps B11 through B13 are repeatedly executed so that commands are read out from the master electronic musical instrument 31 and are processed by nonoperation processing (NOP) until the end command "/" is read out.

In the instant case, the transferred command is "?", so the routine goes from step B8 to step B9. The CPU 32-4 thus initializes the individual circuits such as the tone-generating circuit 32-7 and the routine then goes back to step B10.

In step B10, a check is done as to whether or not the pertinent command is a command ".". In the instant case a decision "No" is yielded, and the routine goes back to step B4.

With a decision "Yes" yielded by step B4, the routine goes to step B5. In the instant case, the first byte of the 3-byte command "S02" shown in FIG. 4 is in the CPU 32-4, and a decision "Yes" is yielded by step B6, so the routine goes to step B14. If the next byte has been transferred from the master electronic musical instrument 31, step B14 yields a decision "Yes", so the routine goes to step B15 in which the second byte of the command, i.e., "0", is read. In a subsequent step B16, a check is done as to whether or not the next one has been transferred from the master electronic musical instrument 31. If a decision "Yes" is yielded, the routine goes to step B17, in which the last byte "2" is set in the CPU 32-4.

In step S18, the CPU 32-4 detects that the 3-byte command designates a swing rhythm. Thus, the CPU 32-4 provides data designating the swing rhythm to the tone-generating circuit 32-7. The tone-generating circuit 32-7 thus starts to produce the swing rhythm at a timing described later.

Subsequent to step B18, step B4 is executed, and if step S4 yields a decision "Yes", step B5 is executed. Since at this time again the first byte of a 3-byte command "T00" has been transferred, the next step B6 yields a decision "Yes", so that steps B14 through B18 are executed in the manner as described. In the instant moment, it is detected in step B18 that the command designates the timbre of a piano. The CPU 32-4 thus provides data designating the timbre of a piano to the tone-generating circuit 32-7 to prepare it for being on.

The routine then goes again to step B4. The next command is command (4) shown in FIG. 4 representing the start of playing, so that steps B5 through B10 are executed. In step B9, a command for starting the rhythm is given to the tone-generating circuit 32-7. Playing in a swing rhythm thus takes place.

In step B10, a decision "No" is yielded, so that step B4 is executed, and the next command is read into the CPU 32-4 in step B4. Since the command is ".", steps B6 through B10 are then executed. In step B10, a decision "Yes" is yielded, so that the routine goes back to step B1. In step B1, the main flow processing is done, and then steps B2 and B3 are executed.

In step B3, a stand-by state is held until the tempo signal generator 32-8 generates the tempo signal. When the tempo signal is generated, step B3 yields a decision "Yes", so that the routine goes to step B4. Consequently, steps B4 through B10 are executed, and then the routine returns to step B1. In this way, steps B1 through B10 are repeatedly executed so long as the master electronic musical instrument 31 provides the command ".". The tone is thus off, i.e., the rest is continued, for a period corresponding to the product of the period of the tempo signal and the number of commands transferred. In the instant case, the period is a quarter rest.

Thus, the tempo executed according to the play data transferred from the master electronic musical instrument 31 can be set by the tempo control knob 32-3 of the slave electronic musical instrument 32, corresponding to the stand-by period of step B1.

When 24 commands "." have been supplied, command (6) in FIG. 4 is then supplied from the master electronic musical instrument 31. This time, step B7 yields a decision "Yes", so that steps B16 through B18 are executed. Thus, in step B18 it is detected that the 2-byte command represents the start "on" of the note do, and the CPU 32-4 turns on the tone in the tone-generating circuit 32-7. The tone-generating circuit 32-7 switches on the note, which is thus sounded through the loudspeaker SP.

The routine then returns to step B4 and then goes to step B5 to read the next command ".". As a result, steps B6 through B10 are executed. Step B10 thus yields "Yes", so that the routine goes back to step B3. Thus, the stand-by state is similarly held in the step B3 until the tempo signal is generated, and thereafter the routine goes to step B4. In this way, with command (7) in FIG. 4, the tone-generating circuit 32-7 generates the note do for a period corresponding to the number of transferred commands ".", i.e., the duration of an eighth note. During this period, steps B1 through B10 are repeatedly executed.

When command (8) in FIG. 4 is read out, the CPU 32-4 executes steps B3 through B7, and B16 through B18. In the instant case, in step B18 it gives the tone-generating circuit 21 a control signal commanding that the note do be turned from on to off.

Subsequently, steps B4 and B5 are executed, and when the CPU 32-4 reads out the first byte of the next command (9) from the latch 15, step B7 yields a decision "Yes", so that steps B16 through B18 are executed. Thus, the start "on" of the next tone re is instructed to the tone-generating circuit 32-7. The next command (10) is similarly processed, so that the note re is held on for a period corresponding to the duration of an eighth note.

In the above way, according to the music playing data transferred from the master electronic musical instrument 31, music can be performed. As mentioned earlier, FIG. 6 shows a timing chart of signals in the case when the portion shown in the rectangle in FIG. 4, i.e., part of the command (10), commands (11) and (12) and part of the command (13), is transferred from the master electronic musical instrument 31 through the interface circuit 32-10. First, steps B3 through B5 are executed according to the tempo signal provided from the tempo signal generator 32-8. As a result, the CPU 32-4 reads out the command "." which has already been set in the latch 32-13. Then, it provides the acknowledge pulse $\overline{\text{ACKNLG}}$ to the master electronic musical instrument 31 and also provides the signal $\overline{\text{READ}}$ to the flip-flop 32-11 to reset the busy signal BUSY. In the CPU 32-4, steps B6 through B10 are similarly executed, and the stand-by state is set in the step B3.

In the master electronic musical instrument 31, it is confirmed from the acknowledge pulse $\overline{\text{ACKNLG}}$ that the previously transferred command "." has been read into the CPU 32-4. When the busy signal BUSY is inverted to the "L" level, the next command, i.e., the first byte "D" in the instant case, is provided to the data bus DATA, and a strobe pulse $\overline{\text{STROBE}}$ is applied to the latch 32-13. As a result, the data "D" is latched in the latch 32-13. Also, the flip-flop 32-11 is set by the strobe pulse $\overline{\text{STROBE}}$, so that subsequent transfer of data from the master electronic musical instrument 31 is inhibited until the busy state is released.

After the lapse of time T shown in FIG. 6, the tempo signal generator 32-8 generates a tempo signal so that a similar processing to that described above is executed. More particularly, the CPU 32-4 executes steps B4 through B7, and B16 through B18 to read the command "DA", instructing termination of the note re to the tone-generating circuit 32-7, then repeatedly executes a similar step processing twice to read command (12) shown in FIG. 4 and instruct the simultaneous start "on" of the notes mi and sol to the tone-generating circuit 32-7.

The processing of this time is executed continuously as shown in FIG. 6. This is done because step B3 is not looped.

When the command "." is read out by the CPU 32-4, a stand-by is held until the input of the next tempo signal. In this way, the piece of music is progressively played, and when the last command (24) is read out, the CPU 32-4 gives a control signal to the tone-generating circuit 32-7 to entirely stop the playing.

As has been shown in the above embodiment, the tempo signal generator 32-8 generates a tempo signal for a period which is set by the tempo control knob 32-3 of the slave electronic musical instrument 32, and the commands "." are processed in synchronism to the input of the tempo signal. Thus, it is possible to play tones or rests of durations corresponding to number of commands "." transferred from the master electronic musical instrument 31. Besides, the period of the tempo signal is variable, even during playing, by manipulating the tempo control knob 32-3, permitting ready changes of the tempo.

The tempo control command is not limited to that in the above embodiment but can be variously modified.

As has been described in the foregoing, according to the invention, the timing with which music playing data is transferred from the electronic apparatus as a master unit to a playing apparatus as a slave unit, can be variably set in the slave unit. Thus, the tempo can be readily set by the slave unit. Particularly, the tempo can be freely varied during playing, particularly when music is automatically played in the slave unit to automatically play the master unit or when music is played manually during automatic playing.

What is claimed is:

1. A music playing system comprising:

a master electronic apparatus including means for generating automatic music playing data;

means coupled to the master electronic apparatus for transferring said automatic music playing data from said master electronic apparatus to a slave music playing apparatus; and a slave music playing apparatus coupled to said master elect apparatus by said transferring means, including:

a tempo setting means for variably setting a tempo of said automatic music playing data transferred from said master electronic apparatus, means for receiving the automatic music playing data transferred from said automatic music playing data generating means of said master electronic apparatus at a timing of transfer corresponding to the tempo set by said tempo setting means, means for generating tones according to the received music playing data, thereby executing a musical performance at the tempo set by said tempo setting means and a keyboard means having a plurality of performance keys which can be used for a manual musical performance at the timing when said tone generating means generate tones according to the automatic musical playing data for an automatic musical performance.

2. The music playing system according to claim 1, wherein said master electronic apparatus is an electronic computer.

3. The music playing system according to claim 2, wherein said electronic computer is a personal computer including:

a keyboard having a plurality of keys for inputting various commands and data;

a central processing unit for executing operational processings according to data input from said keyboard and data input from an external memory; and a CRT display for displaying said input data and results of operational processings.

4. The music playing system according to claim 1, wherein said master electronic apparatus is a music playing apparatus.

5. The music playing system according to claim 4, wherein said music playing apparatus is a master electronic musical instrument.

6. The music playing system according to claim 5, wherein said slave music playing apparatus is a slave electronic musical instrument connected to said master electronic musical instrument via a cable, and said slave electronic musical instrument includes:

an interface circuit for effecting transfer of data to and from said master electronic musical instrument through said cable; and a tone generating circuit connected to said interface circuit.

* * * * *